US006955503B1

(12) United States Patent
Shivers, III et al.

(10) Patent No.: US 6,955,503 B1
(45) Date of Patent: Oct. 18, 2005

(54) METHOD FOR SALVAGING OFFSHORE JACKETS

(76) Inventors: Robert Magee Shivers, III, 4600 Post Oak Pl., Suite 200, Houston, TX (US) 77027; Michael Christopher Tucker, 4600 Post Oak Pl., Suite 200, Bellaire, TX (US) 77027; David Clark Schuman, 4600 Post Oak Pl., Suite 200, Houston, TX (US) 77027

( * ) Notice: Subject to any disclaimer, the term of this patent is extended or adjusted under 35 U.S.C. 154(b) by 0 days.

(21) Appl. No.: 10/903,143

(22) Filed: Jul. 30, 2004

Related U.S. Application Data

(60) Provisional application No. 60/513,270, filed on Oct. 21, 2003.

(51) Int. Cl.[7] ..... E02B 17/02

(52) U.S. Cl. ..... 405/227; 405/228; 405/203

(58) Field of Search ..... 405/227, 228, 405/195.1, 203, 204, 208

(56) References Cited

U.S. PATENT DOCUMENTS

| | | | | |
|---|---|---|---|---|
| 4,705,430 | A * | 11/1987 | Will | 405/227 |
| 5,028,171 | A * | 7/1991 | Gray | 405/227 |
| 5,593,250 | A * | 1/1997 | Smith et al. | 405/203 |
| 6,354,765 | B2 * | 3/2002 | Jones | 405/203 |

* cited by examiner

*Primary Examiner*—Frederick L. Lagman
(74) *Attorney, Agent, or Firm*—Buskop Law Group, P.C.; Wendy Buskop

(57) ABSTRACT

The method for re-deploying an offshore jacket using a plinth involves the steps of locating an offshore jacket; constructing a plinth with a plinth legs, a skirt pile sleeve, a mud mat, a space frame, guide cones, and a trestle per plinth leg; placing the plinth at the second site; driving one skirt pile into each skirt pile sleeve; disconnecting the jacket legs from the seabed at the first site; lifting the offshore jacket above the seabed; moving the offshore jacket from the first site to the second site; and lowering the offshore jacket such that each jacket leg stabs into each guide cone on the plinth until each jacket leg mud mat contacts each trestle; and inserting pin piles through each jacket leg and plinth leg and grouting the pin piles to effect a permanent structural connection between plinth and jacket.

14 Claims, 10 Drawing Sheets

METHOD FOR SALVAGING OFFSHORE JACKETS

The present application claims priority to U.S. Provisional Patent Application Ser. No. 60/513,270 filed on Oct. 21, 2003 now abandoned.

FIELD

The present embodiments pertain to methods for re-deploying an offshore jacket using a plinth.

BACKGROUND

The platform jacket is the structural tower of an offshore platform that supports one or more work decks above the ocean surface. This jacket consists of multiple legs interconnected by a framework of braces. Pile sleeves are connected to the legs at the base of the platform and piles are inserted through the pile sleeves and secured into the ocean floor during installation of the platform. Platform installation continues by securing the piles within the pile sleeves to complete a stable foundation for the platform.

The platform jacket often has a useful life exceeding the duration of profitable oil and gas production at the original site. It may then be desired to salvage the platform jacket for relocation. At this point, a secure pile-to-pile sleeve connection becomes a detriment. The secure pile-to-pile sleeve often requires expensive underwater operations or transportation of the platform to onshore facilities to remove the jacket completely and then replace the pile sleeves.

A need exists for a means to facilitate platform jacket salvage and re-deployment that provides secure pile-to-pile sleeve connection, but also provides for easy separation from piles and reusable pile sleeves.

SUMMARY

An embodiment is a method for re-deploying an offshore jacket using a plinth. The method generally includes locating an offshore jacket comprising at least three jacket legs. Each jacket leg has a jacket leg mud mat. The offshore jacket is connected to a seabed at a first site at a first depth to be re-located to a second site at a second depth, wherein the second depth is deeper below a sea level than the first depth and constructing a plinth.

The plinth generally includes a vertical axis and at least three plinth legs each having a top end and a bottom end. The number of plinth legs is equal to the number of jacket legs. The plinth also has a skirt pile sleeve disposed on each of the plinth legs (or suction cones), at least one plinth mud mat secured to each skirt pile sleeve, and a space frame connected to and providing support for the least three support pile sleeves and the at least three plinth legs. The plinth also has at least one guide cone attached to the top end of each plinth leg. Each guide cone is adapted to receive one jacket leg by guiding and aligning each leg and at least one trestle (or ring) per plinth leg. The plinth also has a trestle disposed on the space frame.

The method further includes placing the plinth at the second site, driving one skirt pile into each skirt pile sleeve, disconnecting the at least three jacket legs from the seabed at the first site, lifting the offshore jacket above the seabed, moving the offshore jacket from the first site to the second site and lowering the offshore jacket such that each jacket leg stabs into each guide cone on the plinth until each jacket leg mud mat contacts each trestle.

BRIEF DESCRIPTION OF THE DRAWINGS

The present method will be explained in greater detail with reference to the appended Figures, in which.

The present method is detailed below with reference to the listed Figures.

DETAILED DESCRIPTION OF THE PREFERRED EMBODIMENTS

Before explaining the present method in detail, it is to be understood that the method is not limited to the particular embodiments herein and it can be practiced or carried out in various ways.

Figure 1:
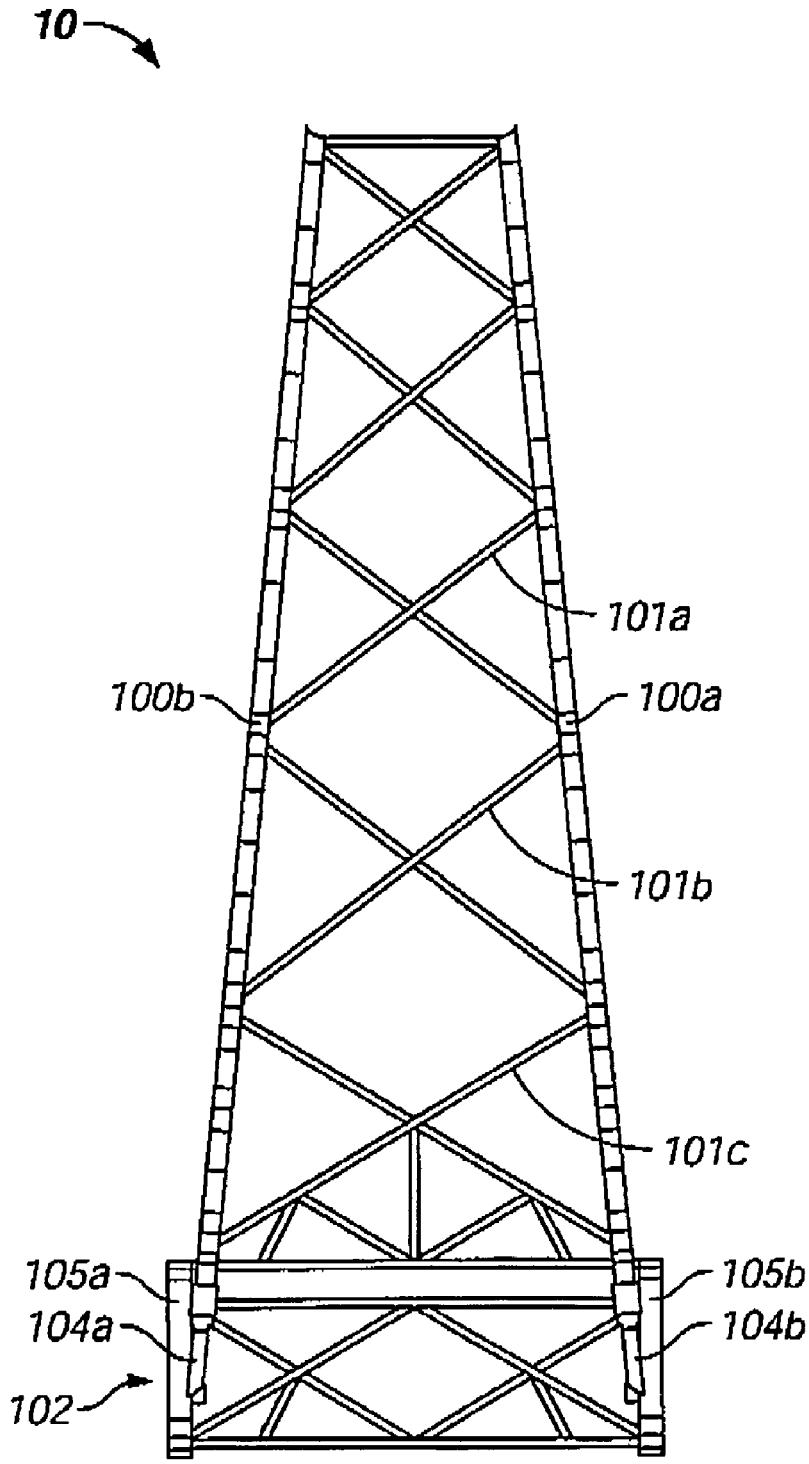
FIG. 1 illustrates a side view of an offshore jacket including a plinth.

FIG. 1 illustrates a side view of an offshore jacket 10 including a plinth 102. The offshore jacket 10 is a structural tower formed by three or more jacket legs 100*a* and 100*b* and a plurality of tubular elements 101*a*, 101*b*, and 101*c*. The tubular elements 101 interconnect and stabilize the jacket legs 100*a* and 100*b*. The offshore jacket 10 is adapted to support one or more work decks above an ocean surface. The one or more work decks are generally used to support operations for oil and gas retrieval and development.

The offshore jacket 10 shown in FIG. 1 includes three jacket legs in a tripod formation (only legs 100*a* and 100*b* are shown in the side view of FIG. 1). The plinth 102 has plinth legs 104*a* and 104*b*. Each plinth leg further includes a skirt pile sleeve 105*a* and 105*b* are shown.

Figure 2A:
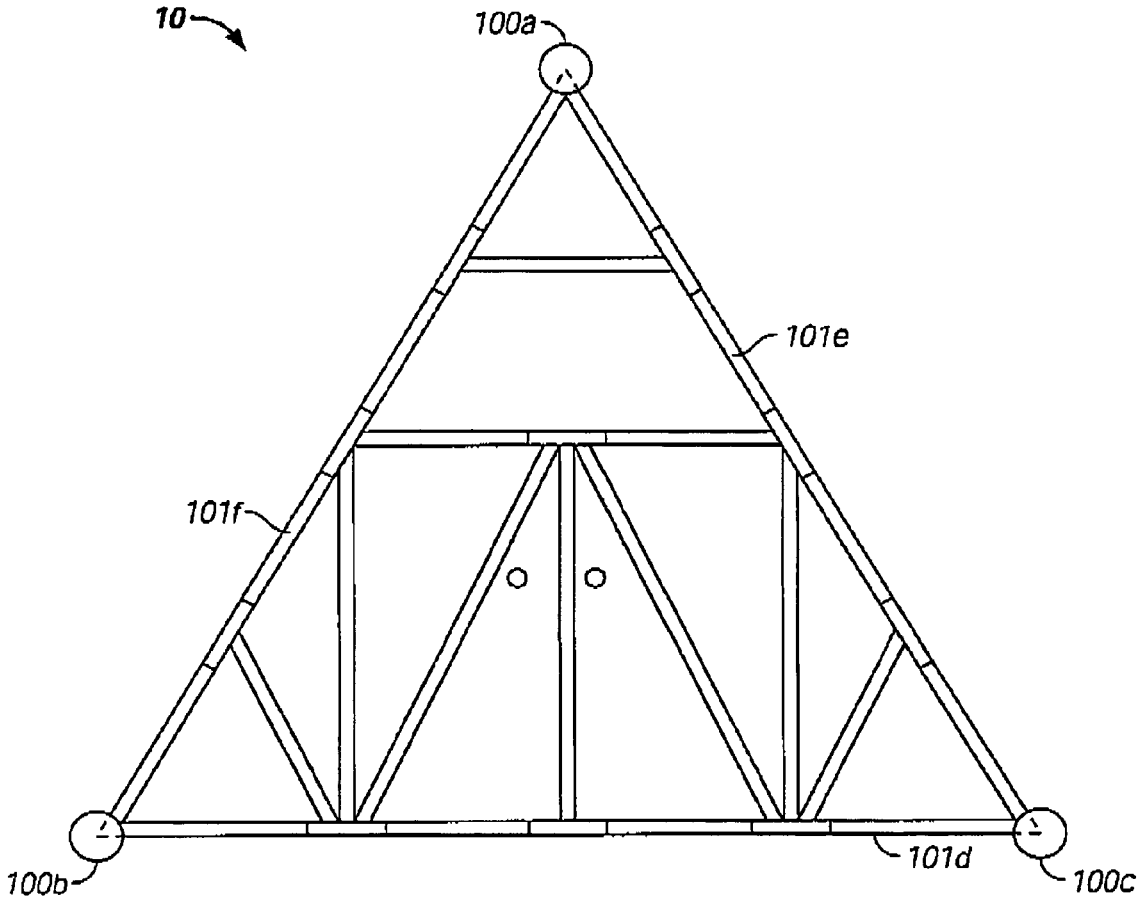
FIG. 2*a* illustrates a top view of one embodiment of the offshore jacket.
Figure 2B:
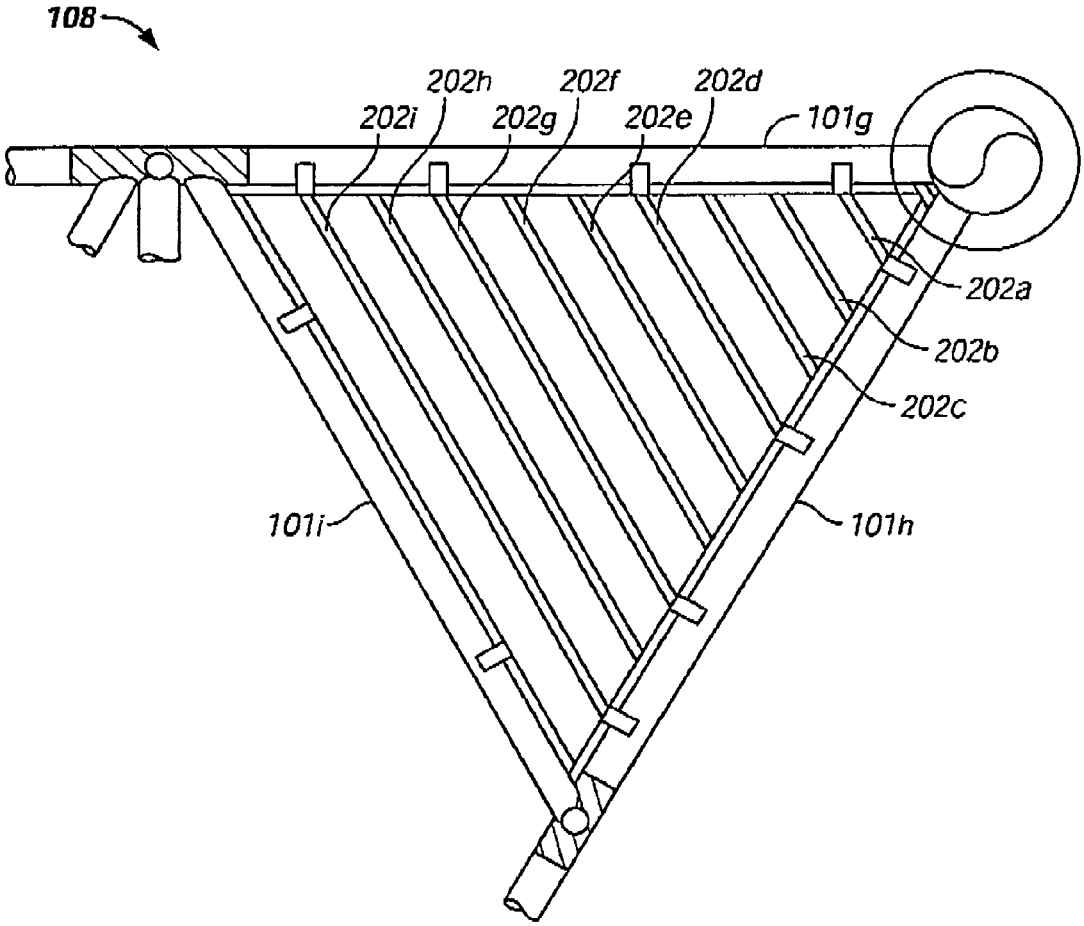
FIG. 2*b* illustrates a top view of an embodiment of a mudmat.

FIGS. 2*a* and 2*b* show the jacket leg 100 including a jacket leg mud mat 108*a* and 108*b* discussed in further detail below.

FIG. 2*a* illustrates a top view of one embodiment where the offshore jacket 10 includes three jacket legs 100*a*, 101*b*, and 100*c*, forming a tripod. As shown in FIG. 1, the jacket legs are connected by a plurality of tubular elements 101*d*, 101*e*, and 101*f*.

FIG. 2*b* illustrates a top view of a mud mat 108 disposed within the plurality of tubular elements 101*g*, 101*h*, and 101*i* that forms a frame on the tripod. The mudmat 108 in the embodiment pictured includes a plurality of supports 202*a*, 202*b*, 202*c*, 202*d*, 202*e*, 202*f*, 202*g*, 202*h*, and 202*i*. In this embodiment, each of the plurality of supports is parallel to one another, but is not required. Plates are disposed under the supports 202*a*, 202*b*, and etc forming a solid mat.

Figure 3A:
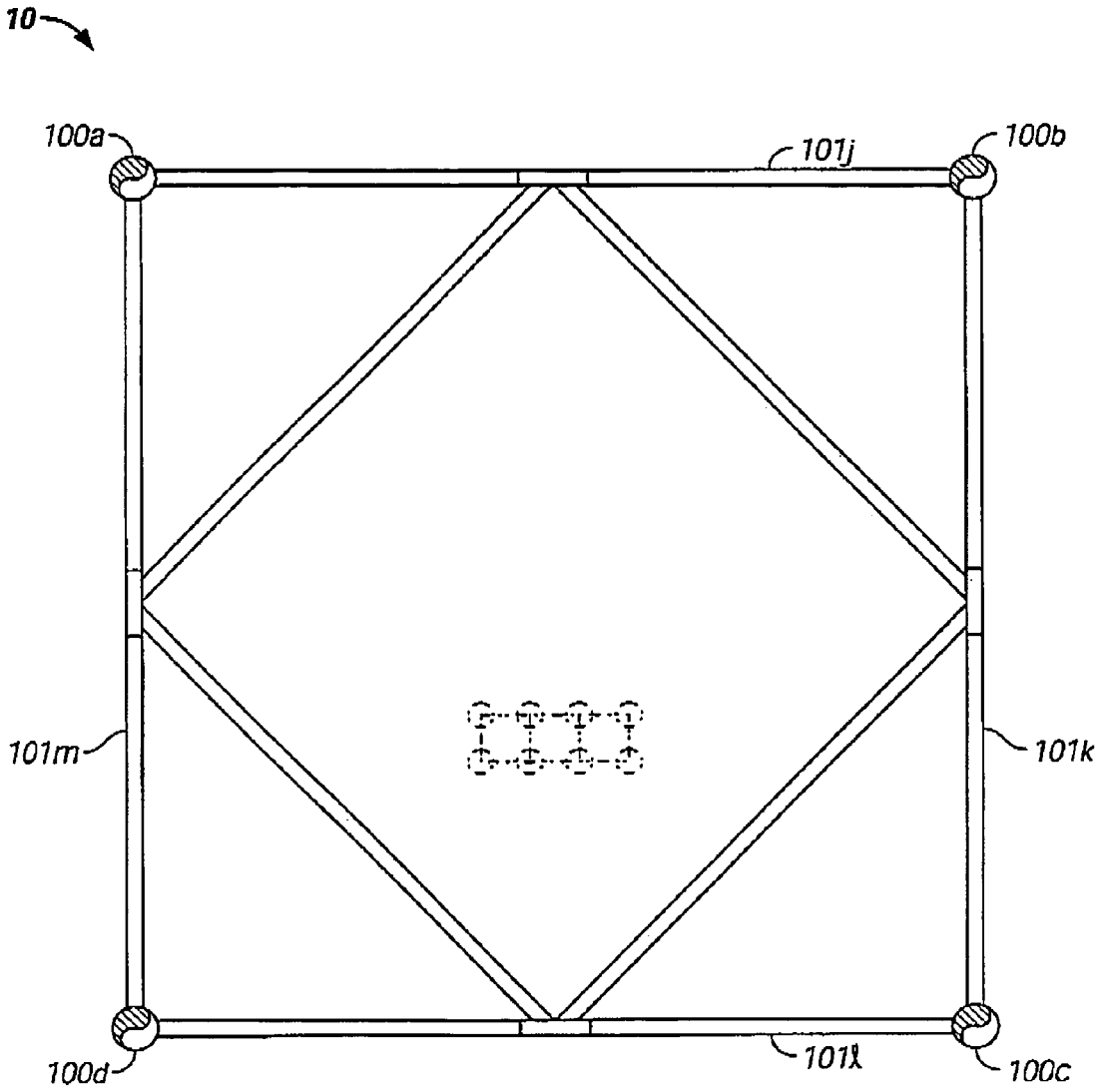
FIG. 3*a* illustrates a top view of another embodiment of the jacket.

FIG. 3*a* illustrates a top view of one embodiment where the offshore jacket 10 includes four jacket legs 100*a*, 100*b*, 100*c*, and 100*d*. The jacket legs are connected by a plurality of tubular elements 101*j*, 101*k*, 101-*l*, and 101*m*.

Figure 3B:
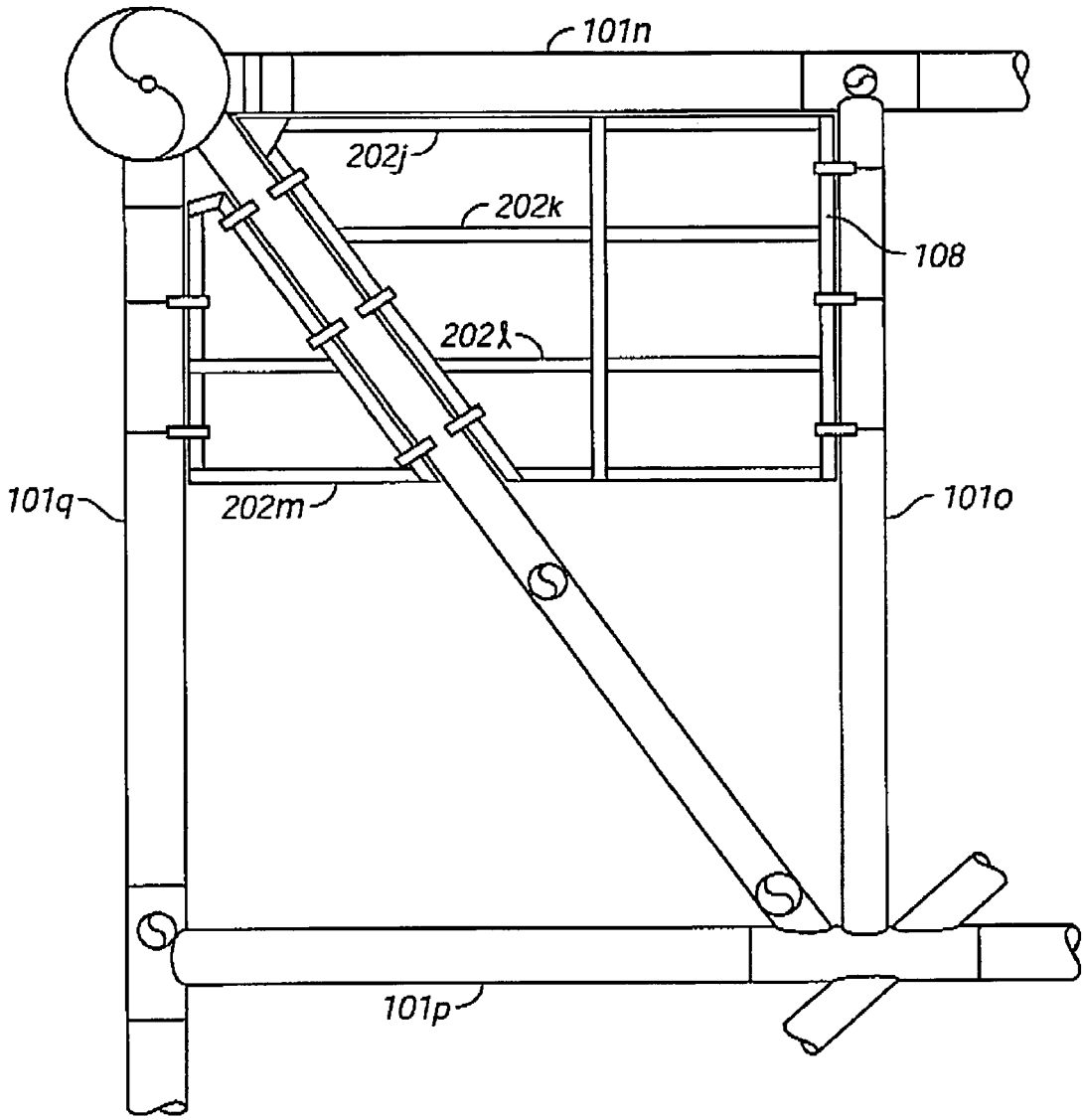
FIG. 3*b* illustrates a top view of another embodiment of the mudmat.

FIG. 3*b* illustrates a top view of the four legged jacket. Another mud mat 108 is also shown in this Figure. A plurality of tubular elements, 101*n*, 101*o*, 101*p*, and 101*q* form the frame of the mud mat. The mud mat includes a plurality of support 202*j*, 202*k*, 202*l*, and 202*m*.

Figure 4:
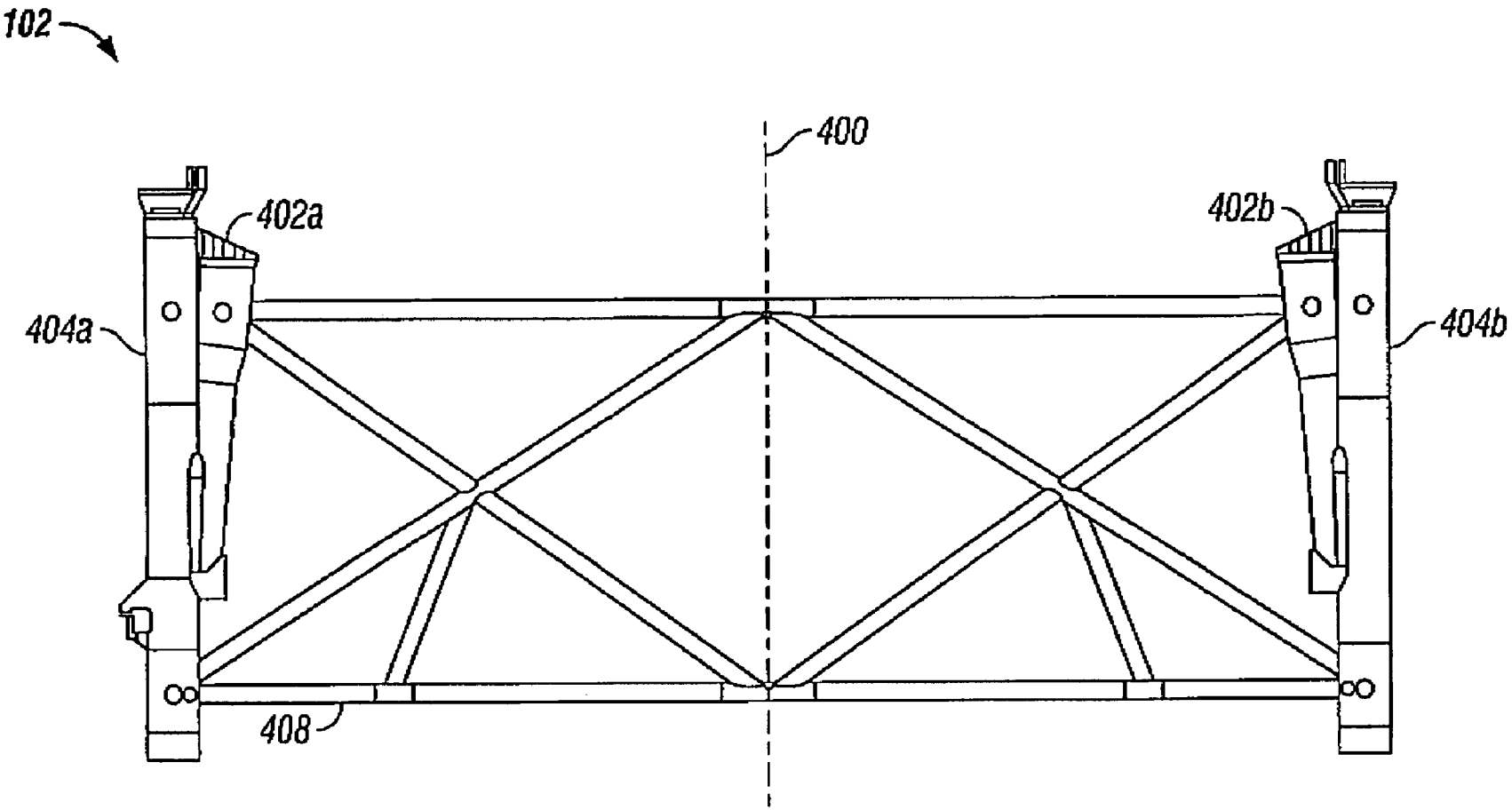
FIG. 4 illustrates a side view of a plinth.

FIG. 4 illustrates a side view of the plinth 102 and FIG. 4*b* illustrates a top view of the plinth 102 used in the four legged jacket. The plinth 102 generally includes a vertical axis 400 and plinth legs 402*a* and 402*b* are shown. Each plinth leg has a top end and a bottom end. The plinth also has skirt pile sleeves 404*a* and *b* with each skirt pile sleeve disposed on each plinth leg. At least one plinth mud mat is secured to each skirt pile sleeve. A space frame 408 is connected to and provides support for skirt pile sleeves 404 and the plinth leg 402.

In one embodiment, the plinth can include horizontal, vertical, and diagonal tubulars with a diameter ranging from about 12 inches to about 48 inches connected to form a space frame. In another embodiment, the tubulars can be in an X pattern, a K pattern or combinations thereof.

The plinth further includes at least one guide cone. Each guide cone is attached to the top end of each plinth leg. Each guide cone is adapted to receive one jacket leg by guiding and aligning each leg.

Figure 5:
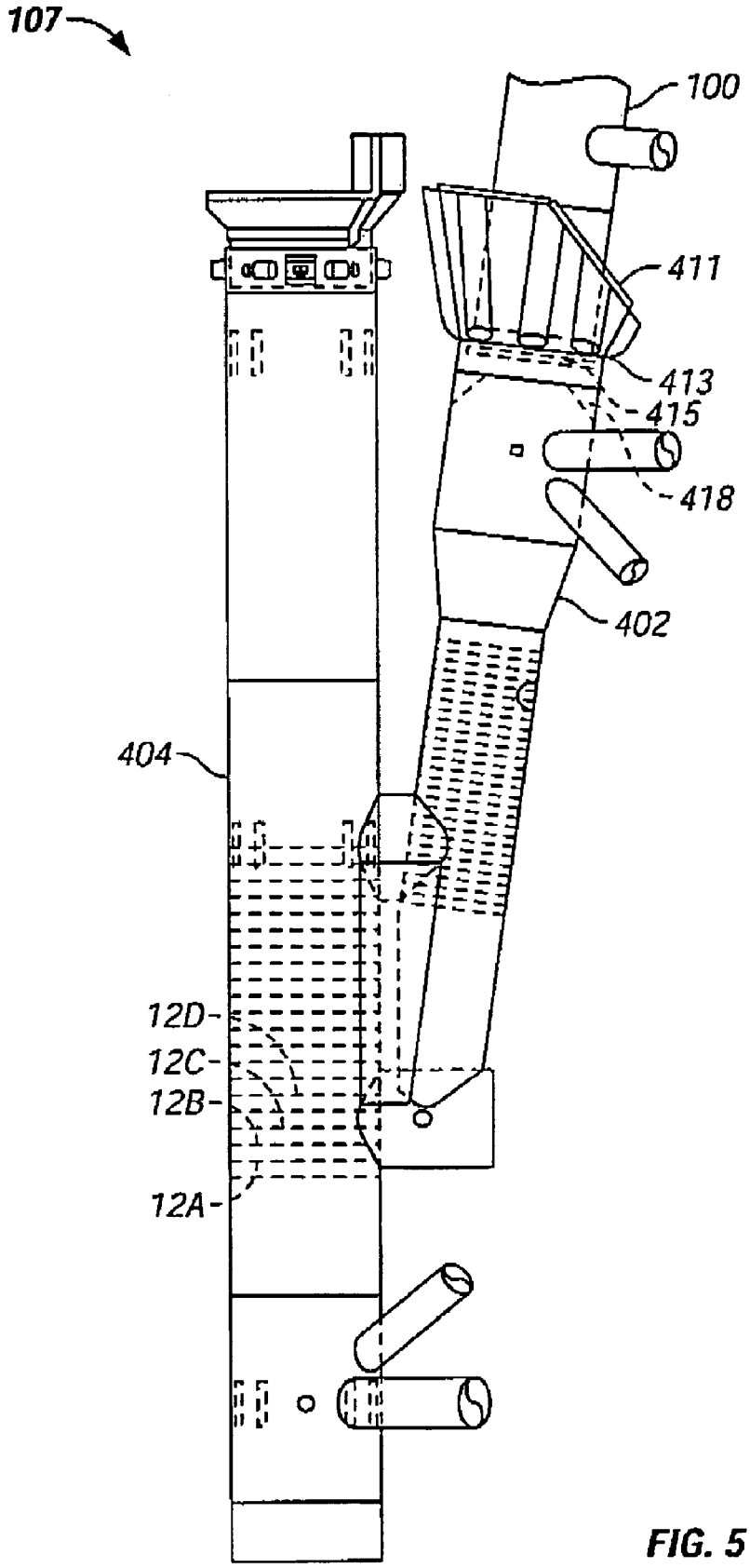
FIG. 5 illustrates a detailed side view of a skirt pile sleeve.

FIG. 5 illustrates a detailed side view of the skirt pile sleeve 404 and plinth leg 402. FIG. 5 also shows that the plinth leg 402 includes a guide cone 411 to aid in placing the jacket leg 100 in position. The guide cone 411 aids in supporting the jacket leg as well. Location 413 shows the bottom of the jacket within the sleeve, which is supported on a ring 415 in this embodiment. The jacket can be supported by other means. The ring 415 is supported by a plurality of gussets 418.

FIG. 5 also illustrates the skirt pile 107 having skirt pile markings 12*a*, 12*b*, 12*c*, and 12*d* on the skirt pile sleeve 404. The skirt pile markings can be located at varying distances from one another, but are shown in FIG. 5 in two and five foot intervals. The skirt pile markings 12*a*, 12*b*, 12*c*, and 12*d* assist in determine the depth of penetration of the skirt pile 107.

Figure 5A:
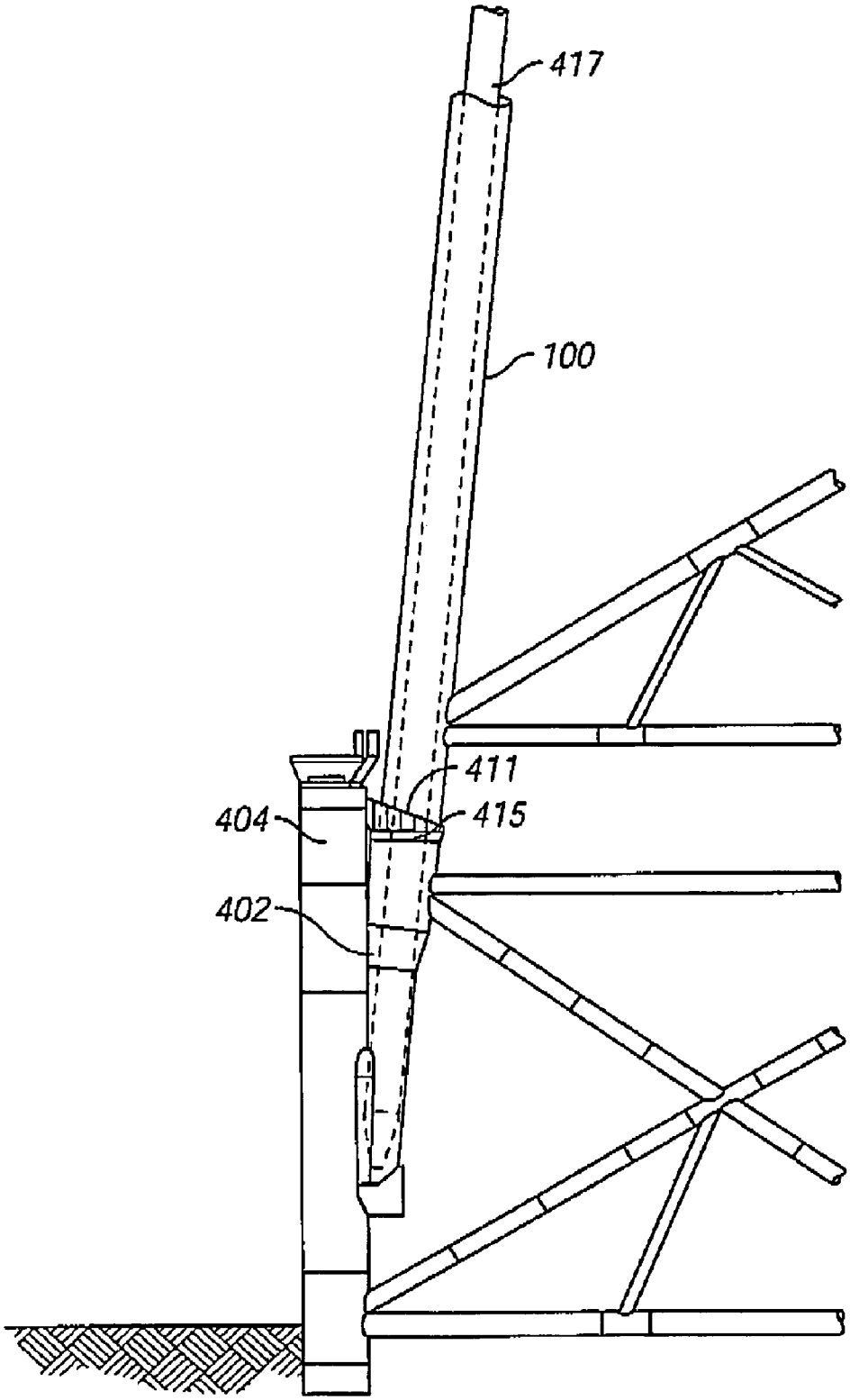
FIG. 5*a* illustrates a pin pile.

FIG. 5*a* illustrates that the jacket can further include a pin pile 417 per jacket leg 100 to pass through the ring 415 to secure the jacket leg to the plinth leg. The pin pile 417 is preferably of a length sufficient to provide adhesion to grout used to secure the pin pile to the plinth leg and the pin pile to the jacket leg.

Figure 6:
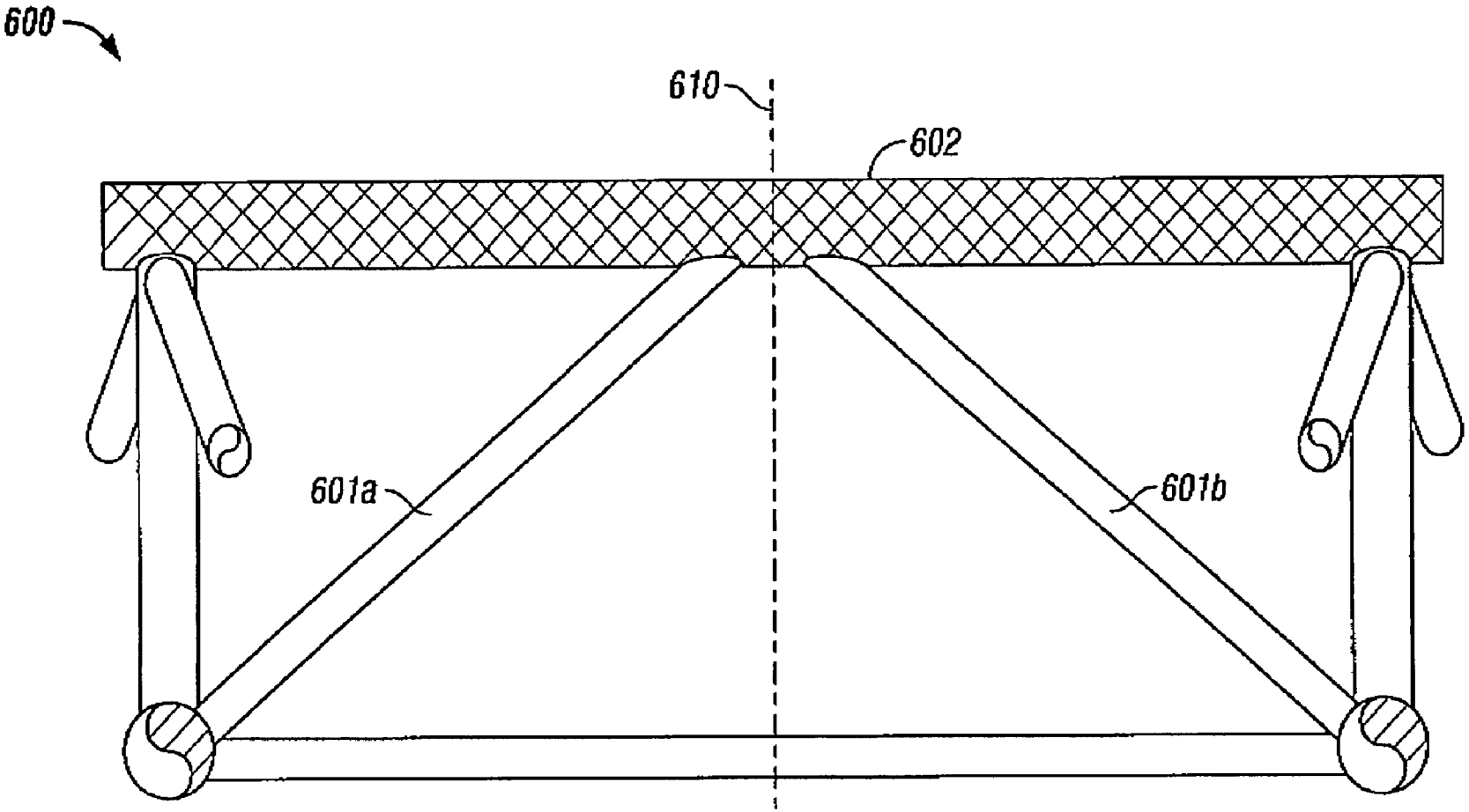
FIG. 6 illustrates a side view of a trestle.

FIG. 6 illustrates a side view of the trestle 600. In the illustrated embodiment, the trestle 600 includes a trestle beam 602. In one embodiment, the trestle further includes at least one trestle leg 601*a* and 601*b* supporting the trestle beam 602 normal to the vertical axis 610 of the plinth 102. In yet another embodiment, the trestle 600 can include at least four trestle legs supporting the beam 602, wherein each trestle leg is at angle which is not parallel to the vertical axis of the plinth 102.

In one embodiment, the plinth includes at least three suction piles, at least one suction pile on each plinth leg rather than at least three skirt pile sleeves.

Figure 7:
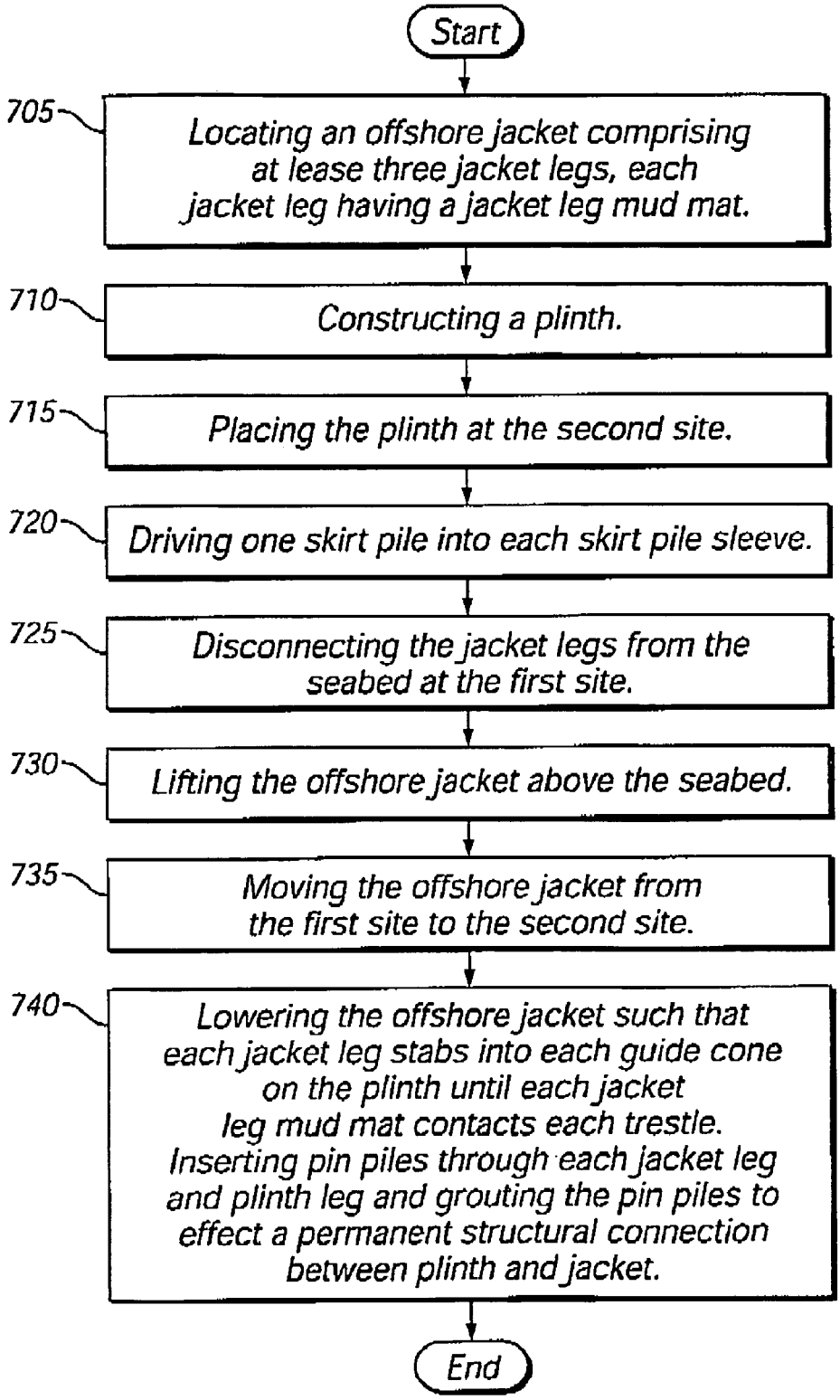
FIG. 7 illustrates a method for re-deploying an offshore jacket using a plinth.

FIG. 7 illustrates a preferred method for re-deploying an offshore jacket using a plinth. The method generally includes locating 705 an offshore jacket having at least three jacket legs, each jacket leg having a jacket leg mud mat, and wherein the offshore jacket is connected to a seabed at a first site and at a first water depth. The jacket is to be re-located to a second site at a second water depth, where the second water depth is deeper than the first depth.

The method further includes constructing a plinth step 710. The plinth generally includes a vertical axis, at least three plinth legs each having a top end and a bottom end, at least three skirt pile sleeves, one skirt pile sleeve disposed on each plinth leg, at least one plinth mud mat secured to each skirt pile sleeve, a space frame connected to and providing support for the least three support pile sleeves and the at least three plinth legs and at least one guide cone attached to the top end of each plinth leg and wherein each guide cone is adapted to receive one jacket leg by guiding and aligning each leg.

In a preferred method, the plinth further includes at least one trestle per plinth leg, each trestle disposed on the space frame.

In another embodiment, the plinth includes at least one ring disposed within each guide cone. The ring can include a flat steel plate with an orifice forming a stop and a plurality of gussets supporting the flat steel plate in the cone.

In one embodiment, the space frame includes a plurality of horizontal tubulars and a plurality of diagonal tubulars connected to form a space frame. The horizontal, vertical, and diagonal tubulars can be connected in an X pattern, a K pattern or combinations thereof.

The method further includes placing the plinth at the second site 715, and driving one skirt pile into each skirt pile sleeve 720. The nest step involves disconnecting the jacket legs from the seabed at the first site 725. The subsequent step involves lifting the offshore jacket above the seabed 730, then moving the offshore jacket from the first site to the second site 735 and lowering the offshore jacket such that each jacket leg stabs into each guide cone on the plinth until each jacket leg mud mat contacts each trestle or ring 740.

In one embodiment, the plinth includes at least three suction piles, at least one suction pile on each plinth leg rather than at least three skirt pile sleeves and the suction are then pressed into the seabed by differential pressure.

While this method has been described with emphasis on the preferred embodiments, it should be understood that within the scope of the appended claims the method might be practiced other than as specifically described herein.

What is claimed is:

1. A method for re-deploying an offshore jacket using a plinth, wherein the method comprises the steps of:

a. locating an offshore jacket comprising at least three jacket legs, each jacket leg comprising a jacket leg mud mat, and wherein the offshore jacket is connected to a seabed at a first site at a first depth to be re-located to a second site at a second depth, wherein the second depth is deeper below a sea level than the first depth;

b. constructing a plinth, comprising:

i. a vertical axis;

ii. at least three plinth legs each comprising a top end and a bottom end, wherein a number of plinth legs is equal to a number of jacket legs;

iii. a skirt pile sleeve disposed on each plinth leg;

iv. at least one plinth mud mat secured to each skirt pile sleeve;

v. a space frame connected to and providing support for the least three support pile sleeves and the at least three plinth legs;

vi. at least one guide cone attached to the top end of each plinth leg and wherein each guide cone is adapted to receive one jacket leg by guiding and aligning each leg; and vii. at least one trestle per plinth leg, each trestle disposed on the space frame;

c. placing the plinth at the second site;

d. driving one skirt pile into each skirt pile sleeve;

e. disconnecting the jacket legs from the seabed at the first site;
f. lifting the offshore jacket above the seabed;
g. moving the offshore jacket from the first site to the second site;
h. lowering the offshore jacket such that each jacket leg stabs into each guide cone on the plinth until each jacket leg mud mat contacts each trestle; and
i. inserting pin piles through each jacket leg and plinth leg and grouting the pin piles to effect a permanent structural connection between plinth and jacket.

2. The method of claim 1, wherein the trestle comprises:
a. a trestle beam; and
b. at least one trestle leg supporting the trestle beam in parallel to the vertical axis of the plinth.

3. The method of claim 2, further comprising four trestle legs supporting the beam, wherein each trestle leg is at an angle from the vertical axis of the plinth.

4. The method of claim 1, wherein the space frame comprises a plurality of vertical, horizontal tubulars and a plurality of diagonal tubulars connected to form a truss.

5. The method of claim 4, wherein the horizontal, vertical, and diagonal tubulars comprise a diameter ranging from about 12 inches to about 48 inches.

6. The method of claim 4, wherein the plinth tubulars are connected in an X pattern, a K pattern, or combinations thereof.

7. A method for re-deploying an offshore jacket using a plinth comprising the steps of:
a. locating an offshore jacket comprising at least three jacket legs, each jacket leg having a jacket leg mud mat, and wherein the offshore jacket is connected to a seabed at a first site at a first depth to be re-located to a second site at a second depth, wherein the second depth is deeper below a sea level than the first depth;
b. constructing a plinth, comprising:
i. a vertical axis;
ii. at least three plinth legs each comprising a top end and a bottom end;
iii. at least three skirt pile sleeves, one skirt pile sleeve disposed on each plinth leg;
iv. at least one plinth mud mat secured to each skirt pile sleeve;
v. a space frame connected to and providing support for the least three support pile sleeves and the at least three plinth legs;
vi. at least one guide cone attached to the top end of each plinth leg and wherein each guide cone is adapted to receive one jacket leg by guiding and aligning each leg; and
vii. at least one ring disposed within each guide cone;
c. placing the plinth at the second site;
d. driving one skirt pile into each skirt pile sleeve;
e. disconnecting the at least three jacket legs from the seabed at the first site;
f. lifting the offshore jacket above the seabed;
g. moving the offshore jacket from the first site to the second site;
h. lowering the offshore jacket such that each jacket leg stabs into each guide cone on the plinth until each jacket leg mud mat contacts each ring; and
i. inserting pin piles through each jacket leg and plinth leg and grouting the pin piles to effect a permanent structural connection between plinth and jacket.

8. The method of claim 7, wherein the ring comprises:
a. a flat steel plate comprising a orifice forming a stop; and
b. a plurality of gussets supporting the flat steel plate in the cone.

9. The method of claim 7, wherein the pin pile is of a length sufficient to provide adhesion to grout used to secure the pin pile to the plinth leg and the pin pile to the jacket leg.

10. A method for re-deploying an offshore jacket using a plinth comprising the steps of:
a. locating an offshore jacket comprising at least three jacket legs, each jacket leg having a jacket leg mud mat, and wherein the offshore jacket is connected to a seabed at a first site at a first depth to be re-located to a second site at a second depth, wherein the second depth is deeper below a sea level than the first depth;
b. constructing a plinth, comprising:
i. a vertical axis;
ii. at least three suction piles, at least one suction pile on each plinth leg;
iii. at least three plinth legs each comprising a top end and a bottom end;
iv. at least one plinth mud mat secured to each skirt pile sleeve;
v. a space frame connected to and providing support for the at least three suction piles and the at least three plinth legs;
vi. at least one guide cone attached to the top end of each plinth leg and wherein each guide cone is adapted to receive one jacket leg by guiding and aligning each leg; and
vii. at least one trestle per plinth leg, each trestle disposed on the space frame;
c. placing the plinth at the second site;
d. pressing each suction pile into the seabed;
e. disconnecting the at least three jacket legs from the seabed at the first site;
f. lifting the offshore jacket above the seabed;
g. moving the offshore jacket from the first site to the second site;
h. lowering the offshore jacket such that each jacket leg stabs into each guide cone on the plinth until each jacket leg mud mat contacts each trestle; and
i. inserting pin piles through each jacket leg and plinth leg and grouting the pin piles to effect a permanent structural connection between plinth and jacket.

11. The method of claim 10, wherein the trestle comprises:
a. a trestle beam; and
b. at least one trestle leg supporting the trestle beam.

12. The method of claim 11, wherein the trestle further comprises at least four legs supporting the beam, wherein each trestle leg is at an angle from the vertical axis of the plinth.

13. The method of claim 10, wherein the space frame comprises a plurality of horizontal tubulars and a plurality of diagonal tubulars connected to form a truss.

14. A method for re-deploying an offshore jacket using a plinth comprising:
a. locating an offshore jacket comprising at least three jacket legs, each jacket leg having a jacket leg mud mat, and wherein the offshore jacket is connected to a seabed at a first site at a first depth to be re-located to a second site at a second depth, wherein the second depth is deeper below a sea level than the first depth;
b. constructing a plinth comprising:
i. a vertical axis;
ii. at least three suction piles, at least one suction pile on each plinth leg;

iii. at least three plinth legs each comprising a top end and a bottom end;

iv. at least one plinth mud mat secured to each skirt pile sleeve;

v. a space frame connected to and providing support for the at least three suction piles and the at least three plinth legs;

vi. at least one guide cone attached to the top end of each plinth leg and wherein each guide cone is adapted to receive one jacket leg by guiding and aligning each leg; and vii. at least one ring disposed within each guide cone;

c. placing the plinth at the second site;

d. pressing each suction pile into the seabed;

e. disconnecting the at least three jacket legs from the seabed at the first site;

f. lifting the offshore jacket above the seabed;

g. moving the offshore jacket from the first site to the second site;

h. lowering the offshore jacket such that each jacket leg stabs into each guide cone on the plinth until each jacket leg mud mat contacts each ring; and i. inserting pin piles through each jacket leg and plinth leg and grouting the pin piles to effect a permanent structural connection between plinth and jacket.

* * * * *